United States Patent [19]

Draugelis

[11] 3,951,539

[45] Apr. 20, 1976

[54] ELECTROSTATIC REPRODUCTION MACHINE WITH IMPROVED TONER DISPENSING APPARATUS

[75] Inventor: Vaidevutis C. Draugelis, Rochester, N.Y.

[73] Assignee: Xerox Corporation, Stamford, Conn.

[22] Filed: Oct. 15, 1974

[21] Appl. No.: 514,685

[52] U.S. Cl. ..... 355/3 DD; 118/637; 222/214

[51] Int. Cl.[2] ..... G03G 15/00

[58] Field of Search ..... 355/3 DD, 3 R, 10; 222/214, 206; 118/637, DIG. 23

[56] References Cited

UNITED STATES PATENTS

| | | | |
|---|---|---|---|
| 2,349,875 | 5/1944 | Mandlak | 222/214 X |
| 3,223,289 | 12/1965 | Bouet | 222/214 X |
| 3,273,485 | 9/1966 | Limberger | 118/DIG. 23 |
| 3,375,806 | 4/1968 | Nost | 355/3 DD |
| 3,453,045 | 7/1969 | Fantuzzo | 355/3 DD |
| 3,538,887 | 11/1970 | Rueckwald | 118/637 X |
| 3,695,224 | 10/1972 | Royka | 355/3 DD |
| 3,733,127 | 5/1973 | Perlis et al. | 355/10 |
| 3,739,800 | 6/1973 | Aasen et al. | 118/DIG. 23 |
| 3,752,576 | 8/1973 | Gerbasi | 355/3 DD |
| 3,767,446 | 10/1973 | Weiler | 355/3 DD |

*Primary Examiner*—R. L. Moses
*Attorney, Agent, or Firm*—Earl T. Reichert

[57] ABSTRACT

Toner within a cartridge is alternately aerated, and expelled from the cartridge. The toner cartridge is connected to a dispensing manifold located within and extending across a developer of an electrostatic reproduction machine. To dispense toner from the cartridge, the cartridge is pressurized so as to expel toner through a plurality of orifices in the manifold without aerating the toner as it is being expelled. After a quantity of toner has been dispensed, the toner within the cartridge is aerated, after which toner is once again expelled through the orifices. In the embodiment illustrated herein, a resilient toner cartridge is used, the cartridge being mounted at a remote location and connected to the manifold by a tube. A mechanism periodically deforms the cartridge to expel toner through orifices in the manifold. When the cartridge is allowed to return to its undeformed shape, air enters the cartridge to aerate the toner therein to prevent the bridging and caking of the toner.

3 Claims, 2 Drawing Figures

ELECTROSTATIC REPRODUCTION MACHINE WITH IMPROVED TONER DISPENSING APPARATUS

BACKGROUND OF THE INVENTION

This invention relates to an improved electrostatic reproduction machine, but more particularly to an electrostatic reproduction machine having an improved toner dispensing apparatus.

In the practice of xerography as described in U.S. Pat. No. 2,297,691 to Chester F. Carlson, a xerographic surface comprising a layer of photoconductive insulating material affixed to a conductive backing is used to support electrostatic images. In the usual method of carrying out the process, the xerographic plate is electrostatically charged uniformly over its surface, and then exposed to a light pattern of the image being reproduced to thereby discharge the charge in the areas where light strikes the layer. The undischarged areas of the layer thus form an electrostatic charge pattern or latent electrostatic image in conformity with the configuration of the original pattern.

The latent electrostatic image is developed by contacting it with a finely divided electrostatically attractable material, such as a resinous powder. The powder is held in the image areas by the electrostatic fields on the layer. Where the field is greatest, the greatest amount of material is deposited, and where the field is least, little or no material is deposited. Thus, a powder image is produced in conformity with the image of the original being produced. The powder image is subsequently transferred to a sheet of paper or other transfer member, and suitably affixed thereto to form a permanent copy.

The latest concept for electrostatic reproduction machines utilizes high speed flash exposure of a document, and a moving photoconductive material in the form of an endless belt which is continuously charged. Additionally, such reproduction machines are provided with a developing system which supplies toner particles in relatively large quantities for solid area coverage, such as a magnetic brush developing apparatus. Thus, after the belt passes the magnetic brush assembly for example, a xerographic powder image is formed on the belt which corresponds to the electrostatic latent image. This powder image is then transferred to a support surface (e.g., a sheet of paper) to which it is fused by a fusing assembly whereby the powder image is caused to adhere to the support surface permanently.

In electrostatic reproduction machines a latent electrostatic image is first produced on a photoreceptor. This latent image is then developed with a fine powder (toner) to produce a developed powder image which is subsequently transferred to a support surface such as paper. As used in most automatic xerographic reproduction machines, the fine toner particles are brought into rubbing contact with a triboelectrically remote and relatively coarser carrier material. The rubbing or mixing action causes the toner particles to become triboelectrically charged to a polarity opposite to that of the carrier, and opposite to that of the latent electrostatic image. This carrier/toner mixture is contained within a developer. In order to sustain continuous operation in an automatic electrostatic reproduction machine, the toner consumed in the development process must be periodically replaced within the developer. New toner has heretofore been packaged in a supply bottle or container, and the toner is poured directly from the container into a receptacle from which the toner will be dispensed. This pouring process has proved to be wasteful and contaminating because some airborn toner particles migrate away from the intended receptacle and onto surrounding machine parts and/or the operator's clothing.

It is often necessary, e.g., in certain color reproduction machines, to locate the toner supply at a location which is remote from the main developer. Also, in these machines, the size of the toner dispenser or toner supply is governed by the available space within the inside of the machine, which space is often at a premium.

Many toner dispensers utilize dispensing rollers to periodically dispense toner into the developer. Often, in these dispensers, the dispensing will begin without any problem but then stop because the toner has bridged or caked within the dispenser and the roller or other dispensing means is not in contact with the toner.

Consequently, what is needed is an improved toner dispensing apparatus having a cartridge which can be easily inserted into a machine and removed therefrom without the risk of contamination. This apparatus should be of relatively simple construction, and when necessary, it should be capable of being mounted at a location which is remote from the main developer. The apparatus should also prevent toner from caking or bridging within the apparatus.

SUMMARY OF THE INVENTION

The present invention relates to a toner dispensing apparatus having a toner cartridge made of a suitable deformable material such as plastic. The toner cartridge is connected to a toner dispensing manifold which is located within the main developer. The toner dispensing manifold has a plurality of dispensing orifices therein, and the toner cartridge is connected to the manifold by means of a connecting tube.

DETAILED DESCRIPTION OF THE INVENTION

Figures 1, 2:
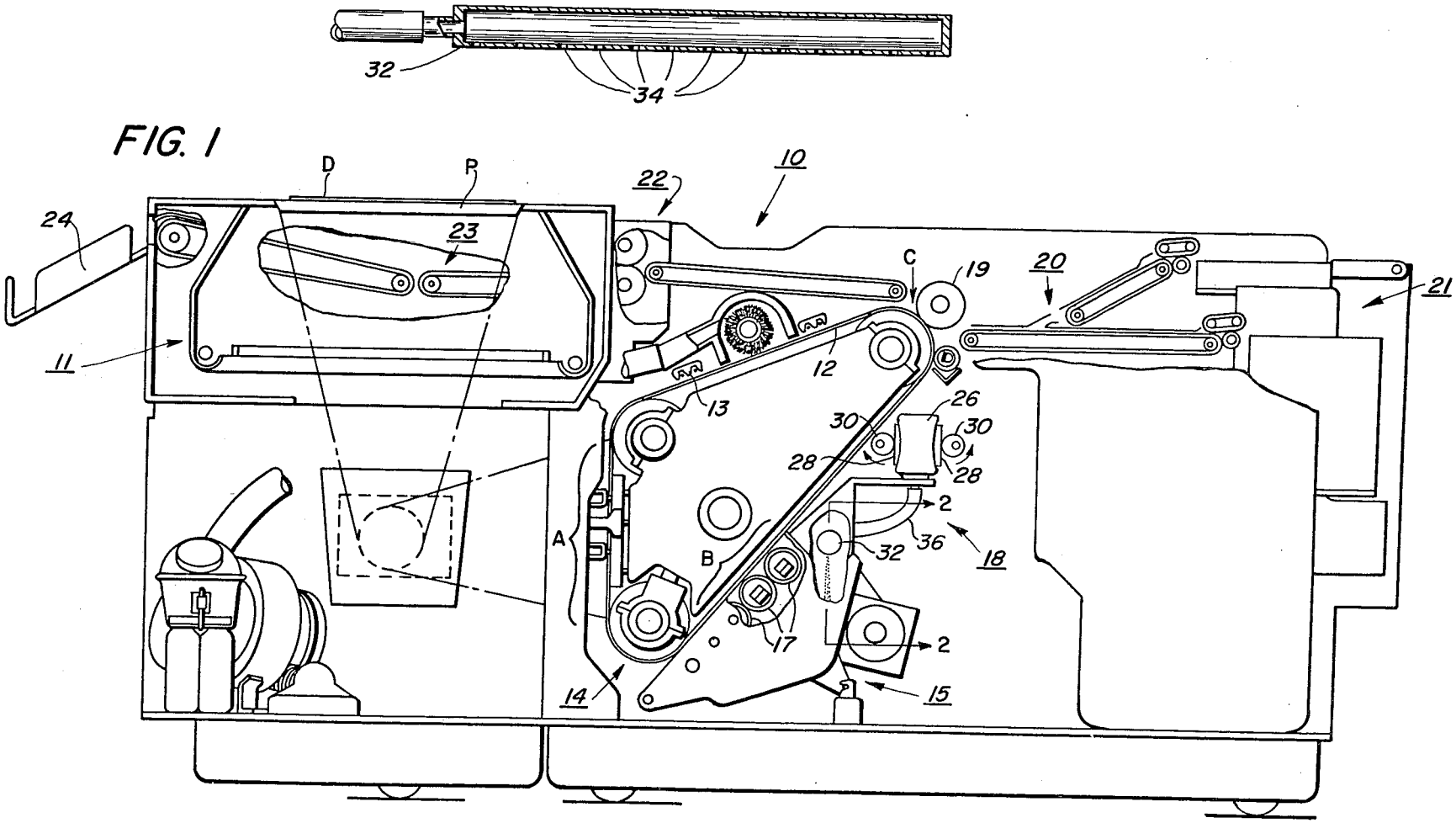
FIG. 1 shows a schematic sectional view of an electrostatic reproduction machine employing an embodiment of the present invention.
FIG. 2 is a view taken through line 2—2 of FIG. 1 showing a cross-section of the dispensing manifold with the connecting tube connected thereto.

For a general understanding of an electrostatic reproduction machine in which the invention may be incorporated, reference is made to FIG. 1 in which the various system components for the machine are schematically illustrated. As in all electrostatic systems of the type illustrated, a light image of a document to be reproduced in projected onto the sensitized surface of a xerographic plate to form an electrostatic latent image thereon. Thereafter, the latent image is developed with an oppositely charged developing material to form a xerographic powder image, corresponding to the latent image on the plate surface. The powder image is then electrostatically transferred to a support surface to which it may be fused by a fusing device whereby the powder image is caused permanently to adhere to the support surface.

In the illustrated machine 10, an original document D to be copied is placed upon the transparent support platen P fixedly arranged in an illumination assembly generally indicated by the reference numeral 11, arranged at the left end of the machine; a platen cover (not shown) is then lowered onto the original D to cover the same. While upon the platen P, an illumination system flashes light rays upon the original thereby producing image rays corresponding to the informational areas on the original. The image rays are projected by means of an optical system for exposing the photosensitive surface of a xerographic plate or photoreceptor in the form of a flexible photoconductive belt 12. The surface of the belt was made photosensitive by the previous step of uniformly charging the same by means of a corona generating device 13. In order to effect image processing, the belt 12 is arranged on a belt assembly generally indicated by the reference numeral 14.

The photoconductive belt assembly 14 is slideably mounted upon two support shafts, one of which is secured to the frame of the machine, and is adapted to drive a belt 12 in the direction of the arrow at a constant rate. During this movement of the belt, the reflected light image of an original on the platen is flashed upon the surface of the belt to produce electrostatic latent images thereon at an exposure station A.

As the belt surface continues its movement, the electrostatic latent image passes through a developing station B in which there is positioned a developer indicated generally by the reference numeral 15, and which provides development of the electrostatic latent image by means of multiple magnetic brushes 17. Toner is periodically dispensed into the developer by an improved toner dispensing apparatus 18.

The developed electrostatic image is then transported by the belt to a transfer station C where a sheet of copy paper is moved between a transfer roller 19 and the belt at a speed in synchronism with the moving belt in order to accomplish transfer of the developed image solely by an electrical bias on the transfer roller. There is provided at this station a sheet transport mechanism indicated generally at 20 adapted to transport sheets of paper from a paper handling mechanism generally indicated by the reference numeral 21 to the developed image on the belt at the station C.

After the developed image is transferred to the sheet, the latter is stripped from the belt 12 and conveyed into a fuser assembly indicated generally by the reference numeral 22 where the developed and transferred xerographic powder image on the sheet material is permanently affixed thereto. After each copy is thus produced, it is delivered via sheet transport mechanism 23 into an output tray 24.

Additional details regarding the subject electrostatic reproduction machine are set forth in a copending U.S. patent application Ser. No. 312,411 assigned to the same assignee. Although not specifically discussed herein, it is understood that the present invention may also be utilized in other types of electrostatic copying or duplicating machines, and is not limited to the high speed duplicating machine disclosed herein. As stated above, for example, this invention is especially suitable for color reproduction machines where space for toner containers is often at a premium. Referring more particularly to the improved toner dispensing apparatus 18, a toner cartidge 26 is mounted at a location which is remote from the developer 15. The cartridge may be made of any suitable deformable material which will not affect the toner. The cartridge 26 is suitably mounted between two plates 28. Mounted on the sides of the plates 28 are cams 30. By means of a connecting tube 36, the toner cartridge 26 is connected to a toner dispensing manifold 32 having a plurality of openings or orifices 34 formed along its length. The manifold 32 extends across the developer 15, and to dispense uniformly across the developer, it is desirable that the orifice sizes vary, i.e., the orifice sizes progressively increase in a direction away from the connecting tube 36. To insert a new cartridge 26 into the machine, the old cartridge is removed and inverted so that it is in an upright position before disconnecting the tube 36. After the cartridge 26 has been disconnected from the tube 36, the new cartridge is connected to the tube, and then inverted and placed between the metal plates 28 where it is secured in place. Thus, there is no danger of contaminating the inside of the machine with toner. It should be understood that any suitable means, e.g., a threaded connector, may be used to connect the cartridge 26 to the connecting tube 36.

In operation, a suitable control mechanism (not shown) may be used to start a motor which drives the cams 30, the control mechanism sensing the toner concentration within the developer 15. The cams deform the container 26, expelling toner out the orifices 34. Various parameters must be controlled, e.g., pressure, size of orifices, etc. to be certain that the toner flows as a fluid, and not expelled along with air; if air along with toner is expelled from the manifold, a powder cloud will be created. As the cams 30 continue to rotate in the direction shown, the cartridge will return to its undeformed state, and as it does so, air rushes in the orifices 34 to clear the manifold and tube 36 of toner and aerate the toner within the cartridge to prevent the bridging and caking of the toner. Thus, the cartridge 26 is continually deformed in this manner to expel toner until the toner concentration within the developer 15 returns to its proper level.

It is understood that rather than use a deformable cartridge, other suitable means may be used to pressurize a toner cartridge to expel toner from the manifold as long as the toner is not aerated as it is being dispensed. For example, various arrangements using bellows, pressurized containers or valves may also be used.

While the invention has been described with reference to the structure disclosed, it is not confined to the details set forth, but is intended to cover such modifications or changes as may come within the scope of the following claims.

What is claimed is:

1. The combination of an electrostatic reproduction machine having means defining a surface upon which an electrostatic latent image may be formed, means for forming the latent image on the surface, and a developer having means for holding a quantity of toner powder and means for transporting the powder from the holding means to the surface to develop the latent image, with an improved toner dispensing apparatus for dispensing toner into the developer, the improved toner dispensing apparatus comprising:

means for containing a supply of toner powder, an elongated manifold mounted within and extending across the holding means, the manifold having means defining a plurality of dispensing orifices along the length of the manifold, a tube connected to the containing means and to the manifold, and means for alternately pressurizing the containing means to expel powder through the orifices into the developer and depressurizing the containing means to aerate the powder to prevent bridging and caking of the powder.

2. The combination of claim 1, wherein the containing means is made of a deformable material, and wherein the pressurizing and depressurizing means includes means for alternately compressing and decompressing the containing means.

3. The combination of claim 1, wherein the sizes of the orifices increase along the length of the manifold in a direction away from where the manifold is connected to the tube.

* * * * *